US006767066B1

(12) United States Patent
Tornero

(10) Patent No.: US 6,767,066 B1
(45) Date of Patent: Jul. 27, 2004

(54) ARTICULATED CHAIR FOR HEALTH CARE

(75) Inventor: Marta V. Tornero, Greensboro, NC (US)

(73) Assignee: Patrician Furniture Co., High Point, NC (US)

( * ) Notice: Subject to any disclaimer, the term of this patent is extended or adjusted under 35 U.S.C. 154(b) by 0 days.

(21) Appl. No.: 10/339,509

(22) Filed: Jan. 9, 2003

(51) Int. Cl.[7] ..... A47C 7/00

(52) U.S. Cl. ..... 297/440.11; 297/354.1; 297/68; 297/84; 297/354.12

(58) Field of Search ..... 297/440.11, 452.56, 297/452.63, 68, 83, 84, 354.1, 354.12, 423.19, 423.24, 423.28, 423.29

(56) References Cited

U.S. PATENT DOCUMENTS

| | | | | | |
|---|---|---|---|---|---|
| 5,318,348 | A | * | 6/1994 | Hess | 297/440.11 |
| 5,338,133 | A | | 8/1994 | Tornero | |
| 5,388,892 | A | | 2/1995 | Tornero | |
| 5,586,811 | A | | 12/1996 | Tornero | |
| 5,660,442 | A | | 8/1997 | Tornero | |
| 5,716,101 | A | * | 2/1998 | Frinier et al. | 297/440.22 |
| 5,762,403 | A | * | 6/1998 | Robinson | 297/440.11 |
| 5,911,478 | A | * | 6/1999 | Goodman | 297/440.11 |
| 6,035,901 | A | | 3/2000 | Stumpf et al. | |
| 6,135,559 | A | * | 10/2000 | Kowalski | 297/354.12 |
| 6,145,924 | A | * | 11/2000 | Mero et al. | 297/68 |
| 6,254,190 | B1 | * | 7/2001 | Gregory | 297/452.1 |
| 6,409,262 | B1 | * | 6/2002 | LaPointe | 297/68 |
| 6,560,827 | B1 | * | 5/2003 | Gross | 24/265 C |
| 6,585,323 | B2 | * | 7/2003 | Gaylord et al. | 297/440.11 |
| 6,644,733 | B1 | * | 11/2003 | Tseng | 297/68 |

OTHER PUBLICATIONS

Pending Utility Patent Application No. 10/256,374 filed Sep. 27, 2002, Marta V. Tornero, pp. 2, 5 and 6.

* cited by examiner

*Primary Examiner*—Peter M. Cuomo
*Assistant Examiner*—Erika Garrett

(57) ABSTRACT

A chair having reclining capabilities is provided for use with infirm or geriatric patients. The chair includes a fabric seat and back which is formed from woven elastomeric yarns which allow by directional strips. The woven fabric provides air circulation to the patient to help prevent skin ulcerations and other ailments produced by prolonged contact. The woven fabric also allows for quick draining and drying due to liquid contact. The seat and back in the preferred embodiment are formed from extruded aluminum members which engage the fabric in a taut condition i.e. by resilient lateral supports.

17 Claims, 5 Drawing Sheets

ARTICULATED CHAIR FOR HEALTH CARE

FIELD OF THE INVENTION

The invention herein pertains to reclining chairs and particularly pertains to a chair for use by patients suffering incapacitating and other ailments as residing in hospitals, retirement homes or the like.

DESCRIPTION OF THE PRIOR ART AND OBJECTIVES OF THE INVENTION

Thousands of patients die each year from progressive skin lesions often occurring from prolonged contact while sitting or laying in one position without adequate air circulation. If unattended such ischemic necrosis and tissue ulceration can advance and include bone destruction, osteomyelitis, septicemia and ultimately death. Hospital workers and medical personnel frequently experience difficulties when handling geriatric patients such as when moving patients in and out of chairs or when changing the patient's position to decrease prolonged pressure on a particular body area. In addition, an increasing problem is encountered by hospital personnel in maintaining chairs used by geriatric patients clean, sanitary and dry.

Thus, with the problems and difficulties encountered in the health care field regarding prolonged skin contact while sitting, it is the objective of the present invention to provide a chair which allows easy ingress and egress of an infirm or geriatric patient.

It is another objective of the present invention to provide a chair which can be easily articulated to an upright or horizontal position.

It is yet another objective of the present invention to provide a chair in which the seat and back are relatively easy to clean and dry and which provides a high degree of air circulation to the patient.

It is still another objective of the present invention to provide a chair in which the seat will allow moisture or body fluids to rapidly drain therefrom such as while bathing a patient in situ.

It is also another objective of the present invention to provide a chair having a seat and back construction to accommodate anatomical pressure points to reduce tissue anoxia in an immobilized or semi-immobilized patient.

Various other objectives and advantages of the present invention will become apparent to those skilled in the art as a more detailed description is set forth below.

SUMMARY OF THE INVENTION

The aforesaid and other objectives are realized by providing an articulated chair of the reclining type having a back which can be rotated from an upright position to a substantially horizontal position. Also included is a foot rest which likewise extends from an open position substantially level with the seat when the back is positioned at a reclining angle to a compact folded position when the back is fully upright. The back and seat are formed with opposing side members from extruded aluminum. The opposing side members are substantially oval in cross-section and include an exterior groove for receiving the edges of a stretchable fabric and an interior groove for mounting U-shaped lateral supports therein. Two lateral supports are positioned both along the back and the seat which, by being U-shaped easily apply outward tension to the side members thus maintaining the fabric in a taut condition. The fabric is formed from elastomeric yarns which provide stretch in both the warp and weft direction. The woven fabric allows air to circulate to the contact points of the patient to aid and assist in preventing ischemic ulcers and other adverse conditions from developing. Likewise, the woven fabric allows moisture to penetrate the fabric and quickly dry should the patient be bathed or washed. In an alternate embodiment of the chair a conventional standard mechanical arm assembly is attached to allow the patient to raise the armor comfort while sitting or lower the arm whereby the patient can be slid laterally during egress.

DETAILED DESCRIPTION OF THE PREFERRED EMBODIMENT AND OPERATION OF THE INVENTION

Figure 1:
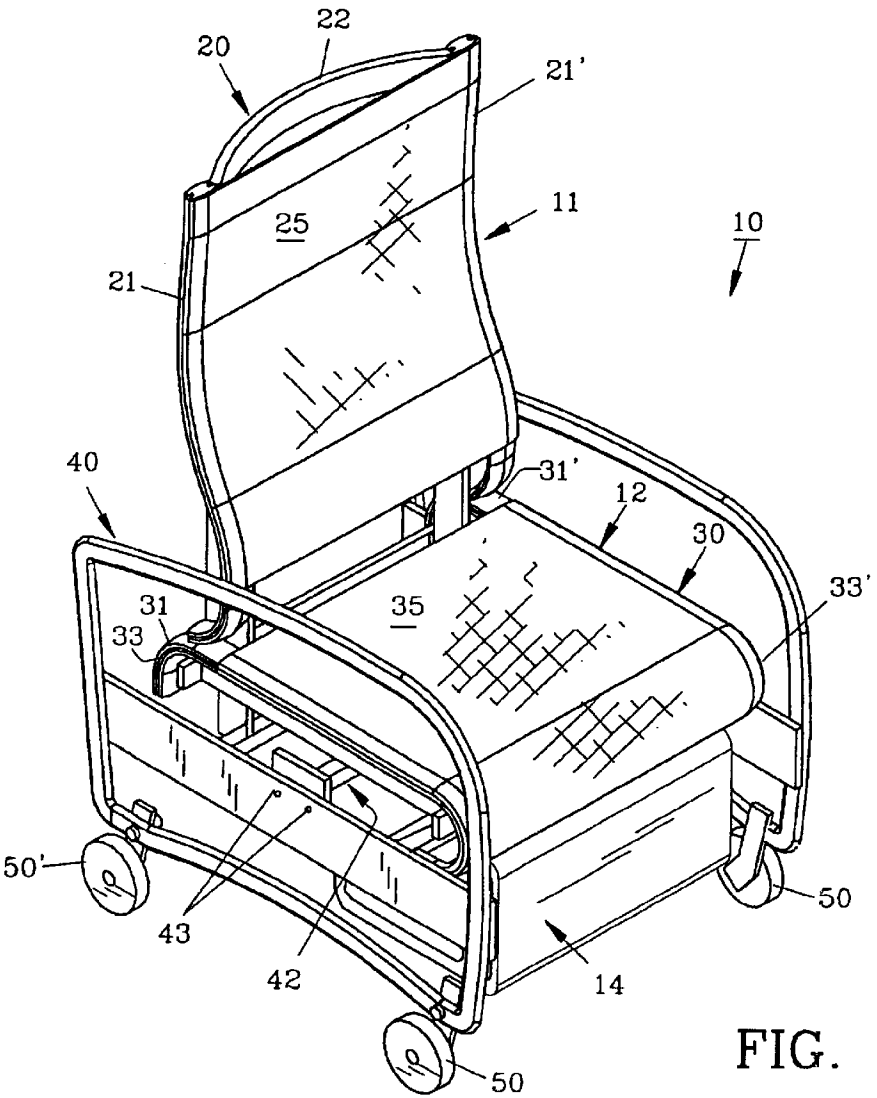
FIG. 1 illustrates a front perspective view of the preferred embodiment of the articulated chair of the invention.
Figure 4:
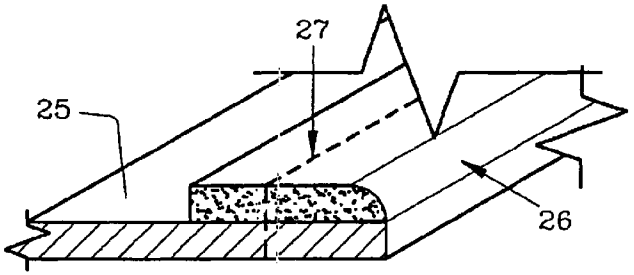
FIG. 4 shows a cross-sectional view of a portion of the back of the chair along lines 4—4 as shown in FIG. 2.
Figure 5:
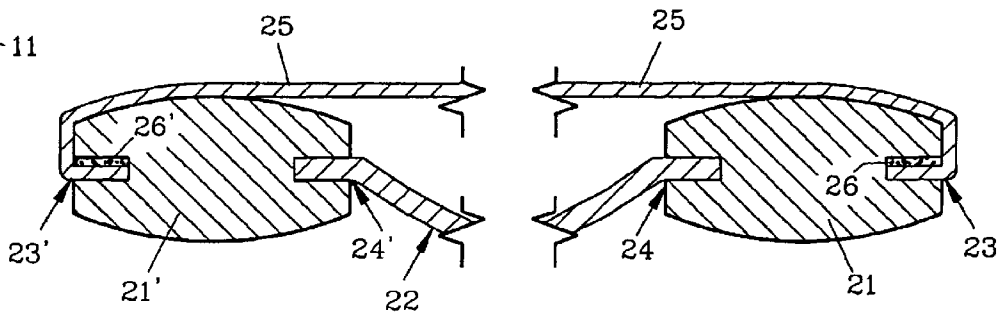
FIG. 5 depicts a corner of one edge of the fabric removed from the back.
Figure 2:
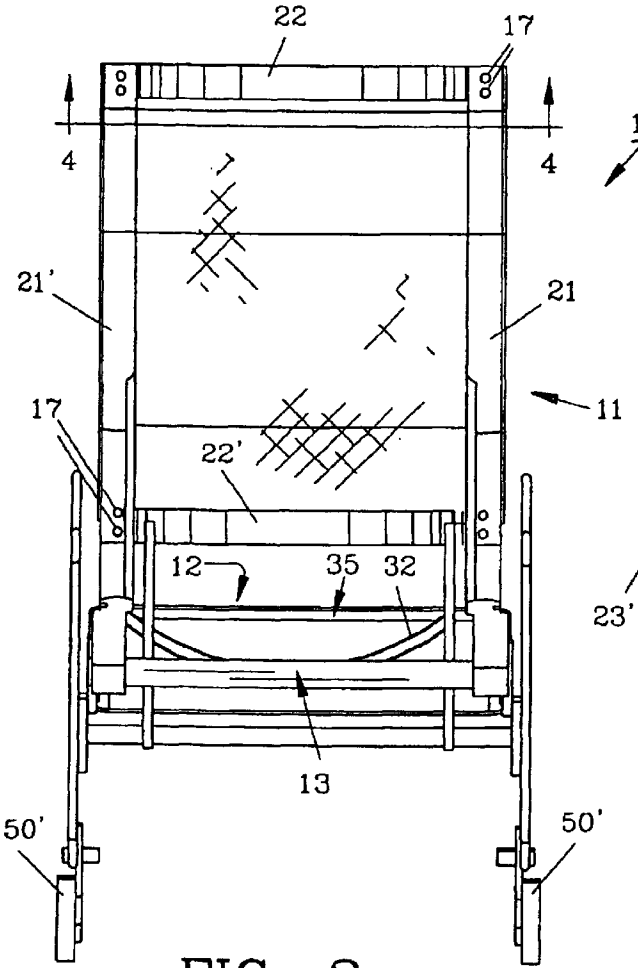
FIG. 2 shows a rear elevational view of the chair as seen in FIG. 1.
Figure 3:
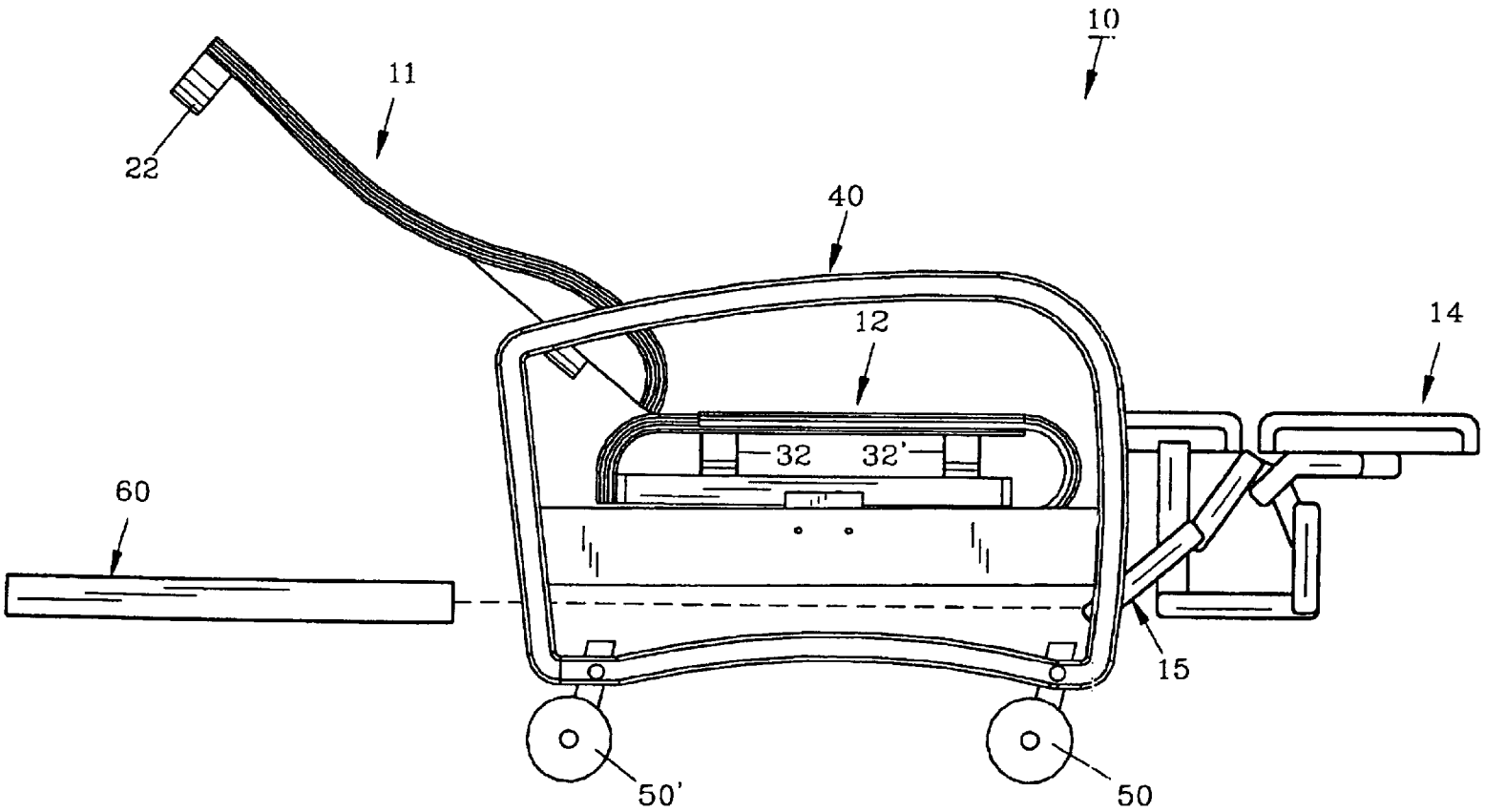
FIG. 3 pictures a left side elevational view of the chair of FIG. 1 with an optional collection pan removed.

For a better understanding of the invention and its operation, turning now to the drawings, preferred articulated chair 10 is shown in FIG. 1 having a back 11 and a seat 12 which are joined indirectly to chair frame 13 as shown in FIG. 2. Frame 13 is attached to a typical reclining mechanism 15 not fully shown therein. Back 11 is movable from an upright position shown in FIGS. 1 and 2 to a reclining position as shown in FIG. 3. Back 11 is affixed to conventional reclining mechanism 15 (not fully shown) well known in the industry. Foot rest 14 is likewise affixed to reclining mechanism 15 shown partially in FIG. 3 which extends as back 11 pivots to recline. Back 11 includes back frame 20 which includes a pair of extruded opposing side members 21, 21' and a pair of U-shaped lateral supports 22, 22' as seen in FIG. 2. Back frame 20 is formed from aluminum and as shown in FIG. 4, side members 21, 21' consist of aluminum extrusions which are oval in cross section and include exterior edge grooves 23, 23' and interior edge grooves 24, 24'. Preferred fabric 25 is positioned in exterior groove 23, 23' whereby arcuate lateral back supports 22, 22', which are somewhat resilient are mounted in interior grooves 24, 24' to apply outward tension and maintain fabric 25 in a taut condition. The edges of fabric 25 include stitches 27 by sewing which attach flexible plastic strip 26 to the edges of fabric 25. The edges of fabric 25 are thus configured to frictionally engage exterior edge grooves 23,23' while lateral back support members 22, 22' apply tension to thus maintain fabric 25 in a taut, stable position on chair back 11.

Preferred fabric 25 is of the woven elastomeric type designed to allow a high degree of air circulation to the patient while preventing collection of fluids thereon. Preferred fabric 25 is constructed of polyester elastomer monofilaments having, preferably a durometer reading of 55 in the warp direction and a diameter of 0.5 millimeters. In the weft direction, 500 dernier elastomeric polyester yarns are utilized of a nominal diameter of 0.1 millimeter. While various other elastomeric fabric specifications and constructions may perform satisfactory, it is important that the stretch and resiliency is obtained with a bi-axial orientation of the elastomeric yarns to ensure proper relief of pressure points when a patient remains seated in the same position for a prolonged period. Bi-lateral (two directional) stretch is of particular importance in areas that exert high pressure such as at bone protrusions of the macro-lumbar region.

In the manufacture of back 12, fabric 25 with flexible plastic strips 26, 26' are sewn to the opposites edge thereof and is inserted into exterior grooves 23, 23' of back side member 21, 21' respectively. After insertion, the side members are expanded (separated) by means of air cylinder jigs to the recommended elongation parameters of fabric 25 (generally 5%). Lateral back support 22, 22' are then inserted into interior grooves 24, 24' and are held in place with metal screws 17 as shown in FIG. 2. Back 12 can then be removed from the jig attached to chair frame 13 by usual assembly techniques:

Preferred seat 12 as shown in articulated chair 10 in FIG. 1 is formed the same way as back 11. There, fabric 35 with plastic edge strips 26, 26' affixed by sewing is likewise positioned within exterior grooves of seat frame 30 which includes a pair of extruded opposing side members 31, 31' which are oval in shape and which include exterior grooves 33, 33' such as shown in FIG. 2. Side members 31, 31' also include interior grooves (not seen) for securing lateral seat supports 32, 32' (32' not seen in FIG. 2). Once formed as described above for back 11, lateral seat supports 32, 32' maintain fabric 35 in a taut posture on seat 12. Fabric 35 is identical to fabric 25 as hereinbefore described and seat 12 is formed using jigs as is back 11 described above.

Side frames 40, 40' which can be fabric covered are affixed to cross brace 42 (FIG. 1) of which reclining mechanism 15 (not fully shown) is mounted. Cross brace 42 is affixed to mounting plates 37, 37' which in turn attach to side frames 40, 40' by screws 43. Pairs of wheels 50, 501 are affixed to side members 40, 40' as shown in FIGS. 2 and 3 to allow easy moving of chair 10. Optional collection pan 60 as seen in FIG. 3 can be slidably positioned between side frames 40, 40' and affixed in place such as by screws, channels or the like. Pan 60 may be formed of a molded plastic and is available for collecting fluid which passes through seat fabric 35 during bathing or an accidental patient discharge.

Figure 6:
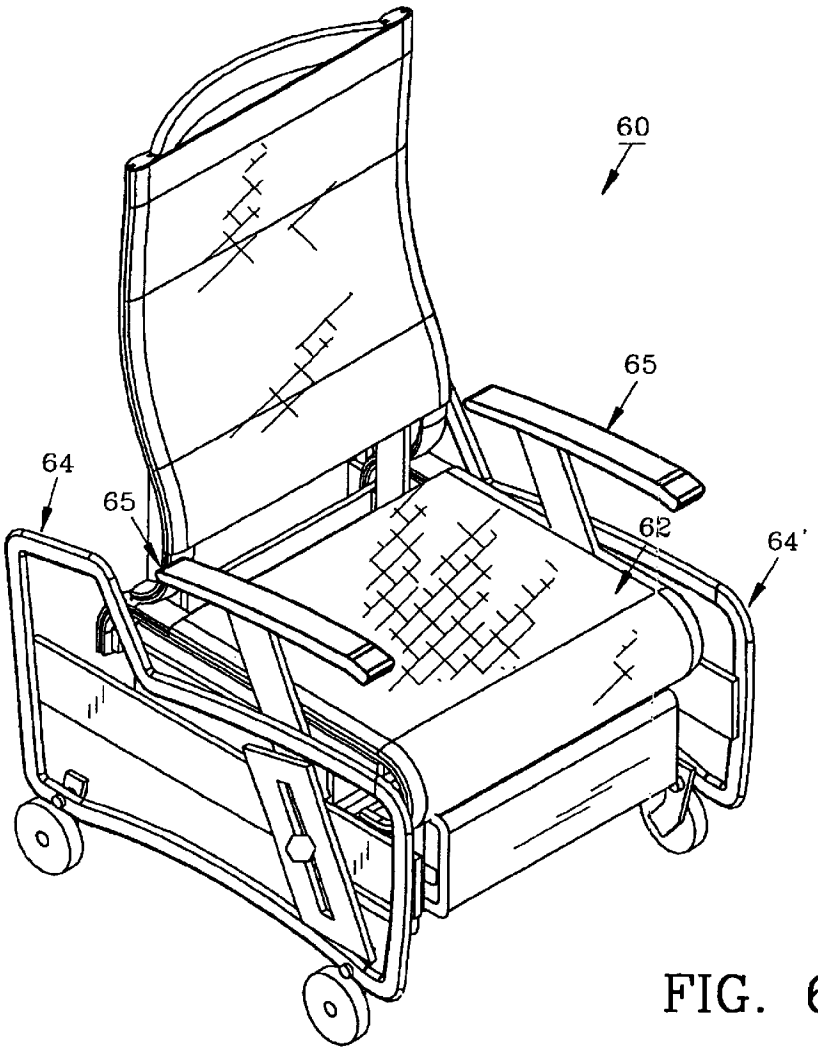
FIG. 6 illustrates a front perspective view of an alternate embodiment of the invention.
Figure 8:
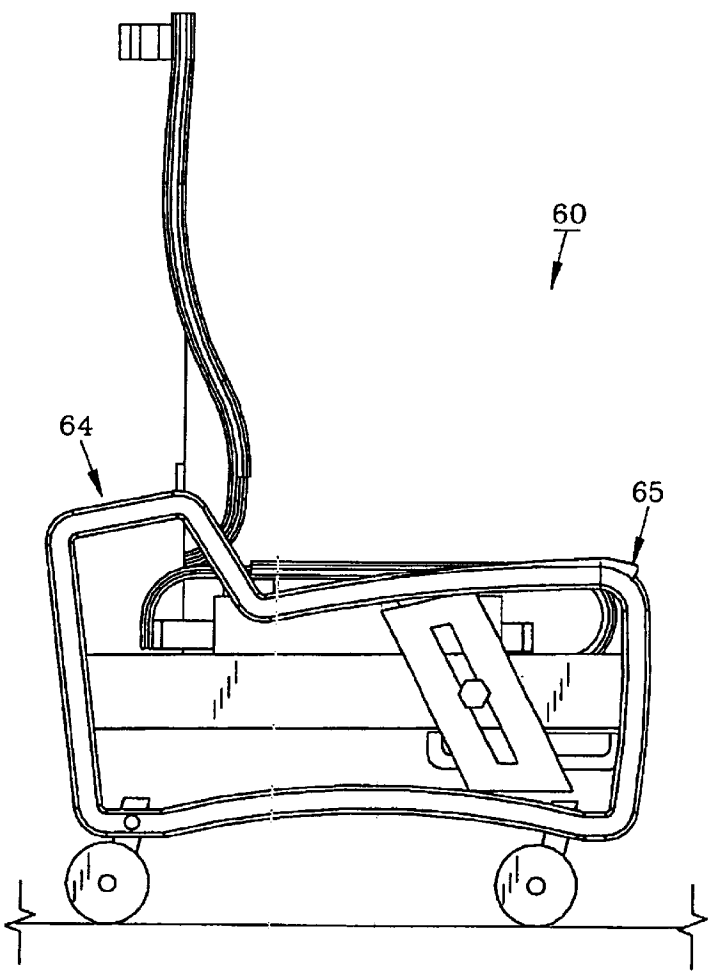
FIG. 8 shows the chair as seen in FIG. 7 but with the arm lowered.
Figure 7:
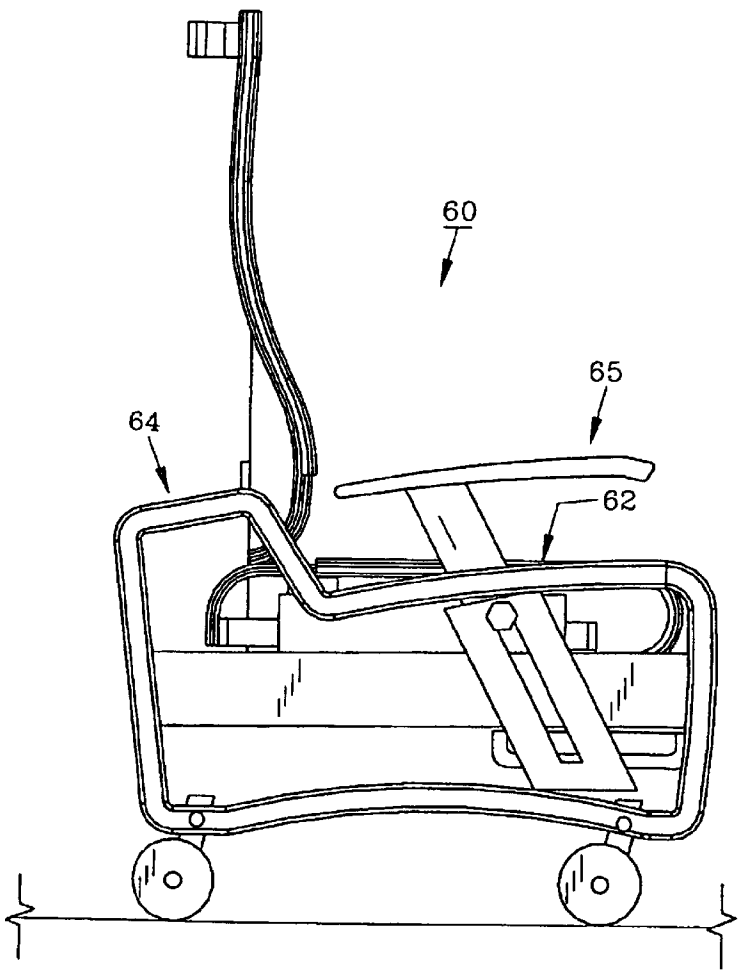
FIG. 7 features a side elevational view of the chair shown in FIG. 6 with the arm raised.

An alternate embodiment of the invention is shown in FIGS. 6–8, with articulated chair 60. Chair 60 is constructed substantially as chair 10 but includes conventional movable arm mechanisms 65, 65'. Arm mechanisms 65, 65' are shown in the raised or extended position in FIGS. 6 and 7 and showed lowered in FIG. 8. A patient can be moved laterally across seat 62 when departing from chair 60 with arm mechanisms 65 or 65' lowered. Arm mechanism 65, 65' are conventionally used with the office chairs and related furniture. As shown in FIGS. 6–8 side frame 64, 64' are configured to accommodate arm mechanism 65, 65' to allow easy patient egress when arm members 65, 65' are lowered.

The illustrations and examples provided herein are for explanatory purposes and are not intended to limit the scope of the appended claims.

I claim:

1. In an articulated chair having a back and seat each for pivotable movement, the improvement comprising: a back frame, said frame comprising a pair of opposing side members, said side members each defining an exterior edge groove, a fabric layer, said fabric layer comprising elastomeric yarns, said fabric layer extending between said opposing side members and disposed within said exterior edge grooves, a tension support, said tension support positioned between said opposing side members to maintain said fabric layer in a taut configuration.

2. The articulated chair of claim 1 wherein said back frame side members each define an interior edge groove, a lateral back support, said lateral back support extending between said side members and contained within said interior edge grooves.

3. The articulated chair of claim 1 wherein said back frame comprises a metal extrusion.

4. The articulated chair of claim 1 wherein said fabric layer comprises polyester monofilaments.

5. The articulated chair of claim 4 wherein said polyester monofilaments are biaxially positioned.

6. The articulated chair of claim 1 wherein said seat comprises a pair of opposing side members, each of said side members defining an exterior edge groove, a fabric layer, said fabric layer extending between said opposing side members disposed within said exterior edge grooves.

7. The articulated chair of claim 6 wherein each of said opposing seat side members defines an interior edge groove, a lateral seat support, said lateral seat support extending between said opposing side members disposed within said side interior edge grooves.

8. The articulated chair of claim 7 wherein said seat side members comprises extrusions.

9. The articulated chair of claim 8 wherein said extrusions comprise aluminum.

10. The articulated chair of claim 8 wherein said extrusions are oval-shaped in cross section.

11. The articulated chair of claim 1 further comprising a recliner mechanism, said recliner mechanism attached to said seat and to said back.

12. The articulated chair of claim 11 further comprising a pair of side frames, a cross brace, said side frames joined to said cross brace, and said recliner mechanism joined to said cross brace.

13. The articulated chair of claim 12 further comprising a pair of movable arms, said movable arms each attached to different ones of said side frames.

14. The articulated chair as claimed in claim 11 further comprises a foot rest, said foot rest joined to said recliner mechanism.

15. An articulated chair comprising: a back frame, a seat frame, a foot rest, a recliner mechanism, said back frame, seat frame and foot rest pivotally attached to said recliner mechanism, said back frame comprising a pair of opposing side members, each of said back side members defining an exterior edge groove and an interior edge groove, a tensioned back fabric, said back fabric comprising biaxially oriented elastomeric yarns, a u-shaped lateral back support, said back fabric extending between said opposing side members and positioned in said exterior edge grooves, and said lateral back support extending between said back side members for tensioning said elastomeric yarns.

16. The articulated chair of claim 15 wherein said seat frame comprises a pair of opposing side members, each of said seat side members defining an exterior edge groove and an interior edge groove, a seat fabric, said seat fabric comprising biaxially oriented elastomeric yarns, said seat fabric extending between said seat side members and positioned within said exterior edge grooves, a lateral seat support, said seat support extending between said seat side members for applying tension to said elastomeric seat fabric.

17. The articulated chair of claim 15 further comprising a pair of side frames, a cross brace, said cross brace attached at opposite ends to different ones of said side frames, and said recliner mechanism attached to said cross brace.

* * * * *